US012722202B2

(12) United States Patent
Fideler

(10) Patent No.: US 12,722,202 B2
(45) Date of Patent: Sep. 1, 2026

(54) SPRAY TIPS HAVING PRE-USE MANUFACTURED WEAR-MIMICKING SURFACE

(71) Applicant: Wagner Spray Tech Corporation, Plymouth, MN (US)

(72) Inventor: Brian Lee Fideler, Jordan, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 191 days.

(21) Appl. No.: 18/649,047

(22) Filed: Apr. 29, 2024

(65) Prior Publication Data

US 2024/0367229 A1 Nov. 7, 2024

Related U.S. Application Data

(60) Provisional application No. 63/499,327, filed on May 1, 2023.

(51) Int. Cl.
*B22F 3/16* (2006.01)
*B22F 5/10* (2006.01)

(52) U.S. Cl.
CPC ..... *B22F 3/162* (2013.01); *B22F 5/10* (2013.01); *B22F 2302/10* (2013.01)

(58) Field of Classification Search
CPC ..... B22F 3/162; B22F 5/10; B22F 2302/10; B05B 7/0075; Y10T 29/49432; Y10T 29/49433; Y10T 29/49401; B23P 15/008
See application file for complete search history.

(56) References Cited

U.S. PATENT DOCUMENTS 4,349,947 A * 9/1982 Rood ..... B23P 15/16 239/599
4,705,124 A * 11/1987 Abrahamson ..... B21K 5/02 175/426
4,736,892 A * 4/1988 Calder ..... B05B 15/534 239/592
9,808,909 B2 11/2017 Nambiath et al.
2002/0084290 A1* 7/2002 Materna ..... B41J 2/14 222/420
2004/0046807 A1* 3/2004 Macler ..... B41J 2/1634 346/45
2006/0182843 A1 8/2006 Fischer et al.
2007/0221762 A1 9/2007 Micheli et al.
2008/0278542 A1* 11/2008 Anderson ..... B41J 2/1642 29/890.1
2018/0178228 A1* 6/2018 Kinne ..... B05B 1/02
2020/0039155 A1 2/2020 Coats
2020/0164390 A1 5/2020 Tam et al.
2021/0170426 A1 6/2021 Stewart et al.

FOREIGN PATENT DOCUMENTS

DE 19914719 A1 * 10/2000 ..... F02M 61/1833

OTHER PUBLICATIONS

Search Report Written Opinion for International Application No. PCT/US2024/027022 dated Aug. 16, 2024, 8 pages.

* cited by examiner

*Primary Examiner* — Steven M Sutherland
(74) *Attorney, Agent, or Firm* — Christopher J. Volkmann; KELLY, HOLT & CHRISTENSON PLLC

(57) ABSTRACT

A spray tip configured to atomize a fluid comprises an inlet configured to receive the fluid; an outlet defining an exit from the spray tip; internal geometry defining a pathway from the inlet toward the outlet; and a manufactured wear-mimicking geometrical feature.

19 Claims, 18 Drawing Sheets

SPRAY TIPS HAVING PRE-USE MANUFACTURED WEAR-MIMICKING SURFACE

CROSS-REFERENCE TO RELATED APPLICATION

The present application is based on and claims the benefit of U.S. provisional patent application Ser. No. 63/499,327, filed May 1, 2023, the contents of which are hereby incorporated by reference in their entirety.

BACKGROUND

Fluid applicators, such as fluid spray guns, are atypically used in a variety of applications to apply fluid, such as paint, to a surface. Fluid spray guns can include a spray tip that is used to break up, or atomize, a liquid material for delivery in a desired spray pattern. A spray tip can have a select geometry to provide a desired spray pattern. With continual use, a spray tip can wear, and the geometry of the spray tip can change which in turn can alter the spray characteristics of the spray tip.

While examples described herein are in the context of applying fluid, in the form of paint, to a surface, it is understood that the concepts are not limited to these particular applications and that fluid spray guns, such as those described herein, are operable to apply a variety of fluids. As used herein, paint includes substances composed of coloring matter, or pigments, suspended in a liquid medium as well as substances that are free of coloring matter or pigment. Paint may also include preparatory coatings, such as primers, and can be opaque, transparent, or semi-transparent. Some particular examples include, but are not limited to, latex paint, oil-based paint, stain, lacquers, varnishes, inks, etc.

The discussion above is merely provided for general background information and is not intended to be used as an aid in determining the scope of the claimed subject matter.

SUMMARY

A spray tip configured to atomize a fluid comprises an inlet configured to receive the fluid; an outlet defining an exit from the spray tip; internal geometry defining a pathway from the inlet toward the outlet; and a manufactured wear-mimicking geometrical feature.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to examples that solve any or all disadvantages noted in the background.

DETAILED DESCRIPTION OF THE DRAWINGS

Figure 1:
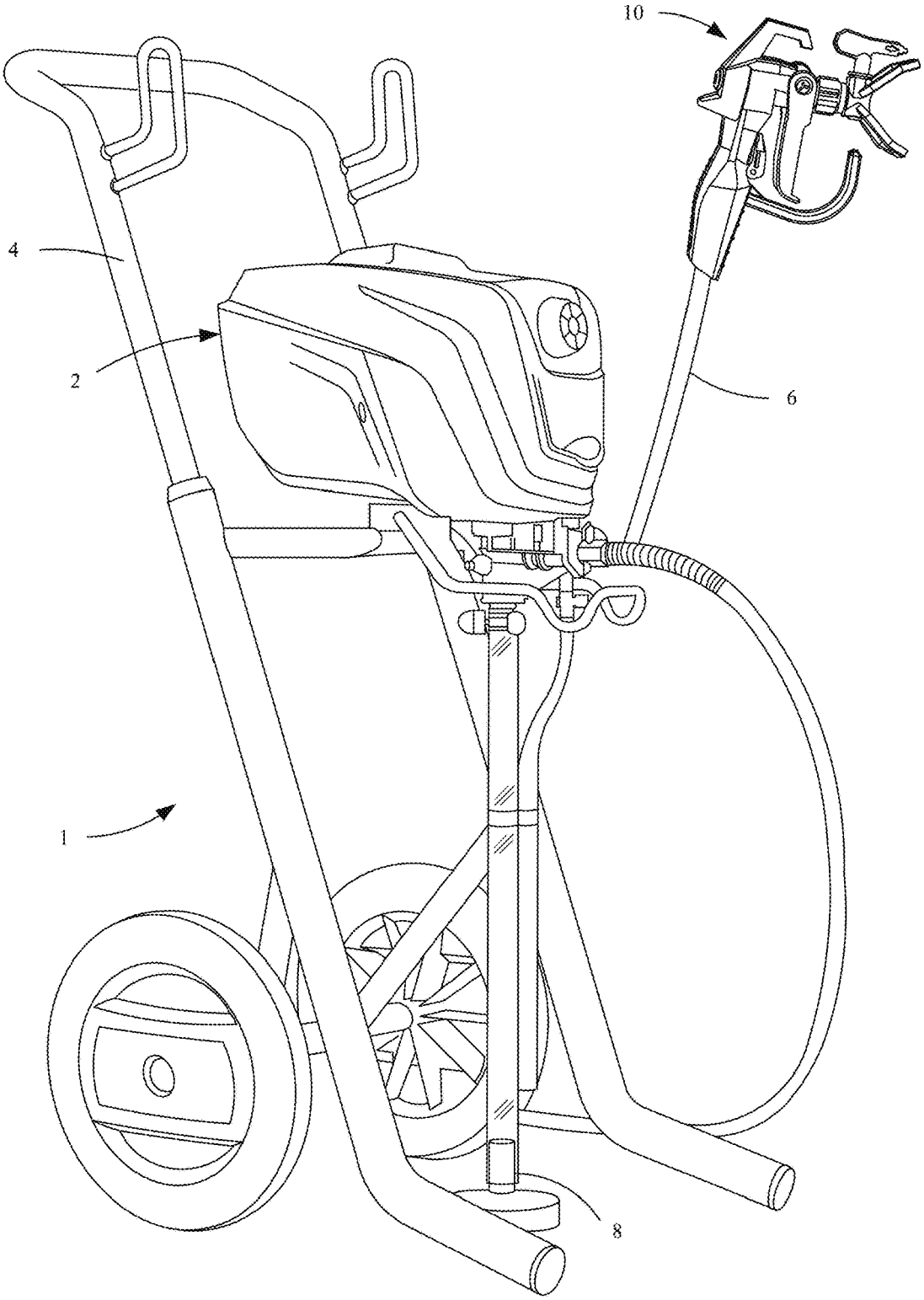
FIG. 1 is a perspective view showing one example fluid application system.

For the purposes of promoting an understanding of the principles of the present disclosure, reference will now be made to the examples illustrated in the drawings, and specific language will be used to describe the same. It will nevertheless be understood that no limitation of the scope of the disclosure is intended. Any alterations and further modifications to the described devices, systems, methods, and any further application of the principles of the present disclosure are fully contemplated as would normally occur to one skilled in the art to which the disclosure relates. In particular, it is fully contemplated that the features, components, steps, or a combination thereof described with respect to one example may be combined with the features, components, steps, or a combination thereof described with respect to other examples of the present disclosure.

In some current systems, spray tips (or tip pieces) are manufactured from carbide (e.g., tungsten carbide). Carbide has a hardness (e.g., tungsten carbide has a Mohs' hardness of 9) that provides for better wear characteristics in a high-pressure fluid application system as compared to wear characteristics of some other materials. In some current systems, machining (e.g., grinding, etc.) of the carbide is used in the production of the spray tips. For instance, in some current systems, grinding is utilized to produce the outlet of the spray tip. Often, diamond tools, such as diamond grinding wheels, are used in the grinding of the carbide to produce the outlet. While an outlet can be formed using such grinding, geometry of such outlets is limited by the cross-section of the diamond tool used in the grinding.

The geometry of a spray tip outlet affects spray pattern as well as operating parameters of the spraying system, such as required flow rate and pressure. Additionally, grinding with a diamond-tool tends to leave sharp edges which tend to wear faster. Once the sharp edges wear down, the spray pattern and flow characteristics of the fluids are altered. For example, a worn spray tip will tend to have a spray pattern that differs from the intended (i.e., as manufactured) spray pattern and will typically result in more fluid output at the same pressure. This wear requires either adjustment by the operator or control system of the spraying system or error will result. In some cases, even when adjustments can be made to compensate for the wear, such adjustments are done in a reactive fashion and thus not all error can be prevented.

Provided herein are systems and methods for utilizing laser ablation in the production of spray tips. Laser ablation of spray tips allows for more flexibility in geometry of certain structures of the spray tips, such as the outlets of the spray tips, as compared to grinding. Additionally, a spray tip produced with laser ablation need not have sharp edges, such as those generated by the grinding process described above, and thus a spray tip produced with laser ablation will have better wear characteristics as compared to a spray tip produced by the grinding process described above.

Further, while use of a robust material such as carbide (e.g., tungsten carbide) improves the wear characteristics of a spray tip, as compared to use of other types of materials, wear still occurs. Generally, known spray tips have a non-linear wear curve. The rate of wear during an initial use period of known spray tips (e.g., during the spraying of the first (approximately) 25 gallons of fluid) is higher than the rate of wear after the initial use period. This can be frustrating to end users as the spray behavior of the spray tip changes with wear, and most drastically from the beginning to the end of the initial use period, requiring more frequent adjustments to the spraying system (e.g., pressure setting adjustments, motor/pump speed adjustments, spray distance, etc.) or adjustments of higher magnitude, or both. During this initial use period, an end user may be required to make multiple adjustments during the course of a single job. In subsequent use periods, the wear rate being less, the frequency or magnitude of adjustments, or both, are less than in the initial use period. Thus, during the subsequent use period, an end user may be able to finish one or more jobs without having to make an adjustment to account for changing spray characteristics of the tip.

Provided herein are systems and methods for providing a pre-use, as manufactured spray tip having a manufactured wear-mimicking surface (or geometrical feature). The manufactured wear-mimicking surface (or geometrical feature) provides for an as manufactured spray tip having a geometry that matches or approximates the geometry of a spray tip having been used through the initial use period. This provides for a more linear wear curve of the spray tip as manufactured, improving end user experience and reducing the frequency and magnitude of fluid application system adjustments. The manufactured wear-mimicking surface can be provided in a variety of ways such as by laser-ablation, sandblasting, hydroerosive machining (or grinding), with use of a mold or die (used in metallurgy manufacturing processes), or in other ways.

Wear-mimicking is used herein to indicate that the wear-mimicking surface (or wear-mimicking geometrical feature) is manufactured, prior to use of the spray tip by an end user (e.g., to spray paint or another fluid) and before wear from use by the end user.

FIG. 1 is a perspective view showing one example fluid application system 1. Fluid application system 1, illustratively shown as an airless fluid spraying system (e.g., a high efficiency airless spraying system), includes pump 2 that is mounted on a cart 4 and couples to applicator 10 through fluid delivery line 6 (e.g., a hose). Pump 2 includes a fluid intake 8 that is disposed within a fluid source (e.g., a five-gallon bucket of paint). Pump 2 pumps the fluid from the fluid source through fluid intake 8 and pumps the fluid at a given pressure to applicator 10 through fluid delivery line 6. In one example, pump 2 can pressurize the fluid above 1500 PSI, such as between 1500-3500 PSI.

Figure 2:
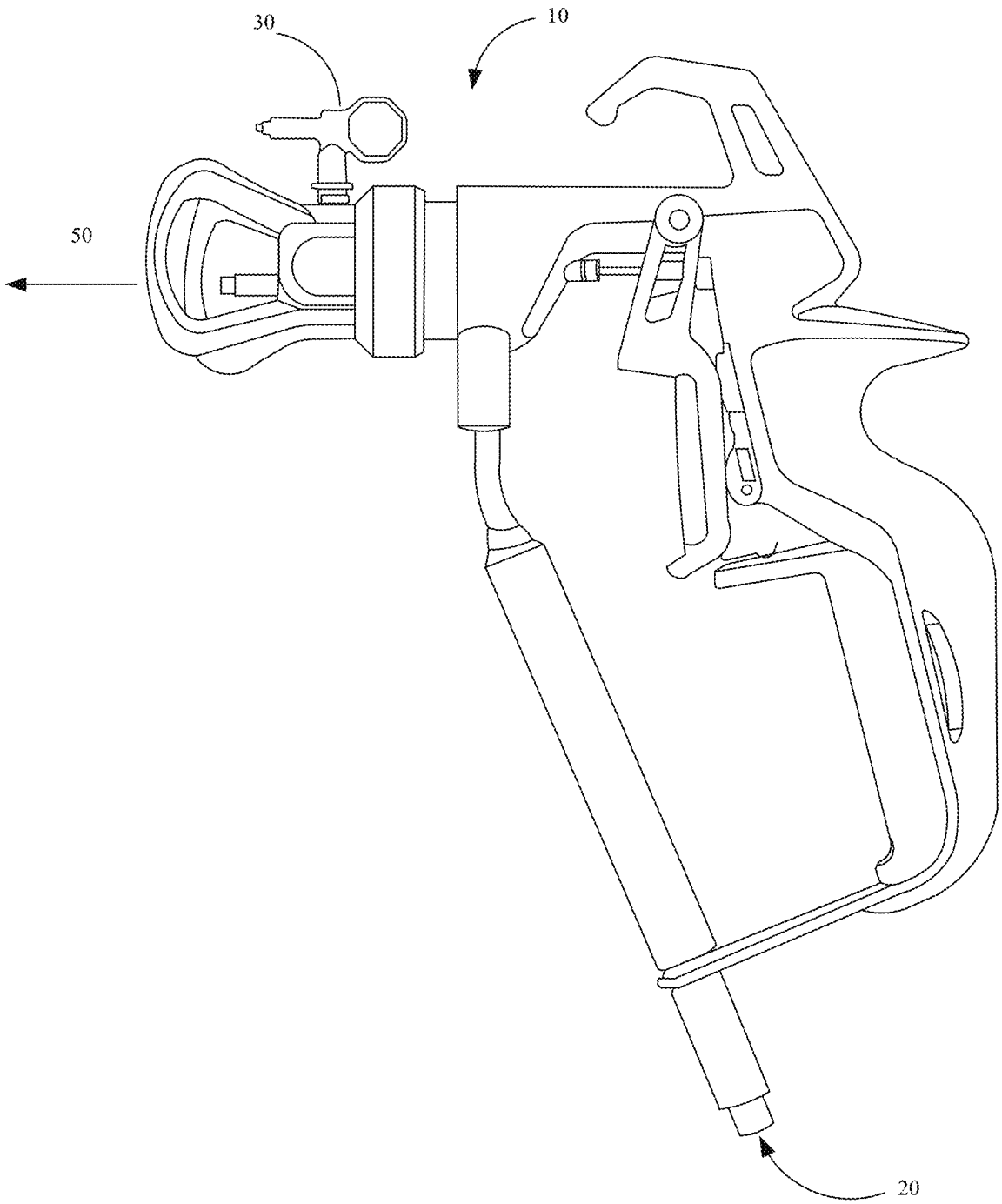
FIG. 2 is a side view showing one example fluid applicator.

FIG. 2 is a side view showing an example applicator 10. Applicator 10 is used in a fluid spraying system (e.g., fluid application system 1) to apply fluid to a surface (e.g., apply paint to a wall). The fluid enters through inlet 20, and exits from outlet 50, after passing through a fluid channel (not explicitly shown) within applicator 10. Fluid inlet 20 may be coupled to a fluid delivery line, such as fluid delivery line 6. Tip assembly 30 is coupled to applicator 10 and has an outlet 50. Tip assembly 30 often is reversible or removable from applicator 10.

Figure 3:
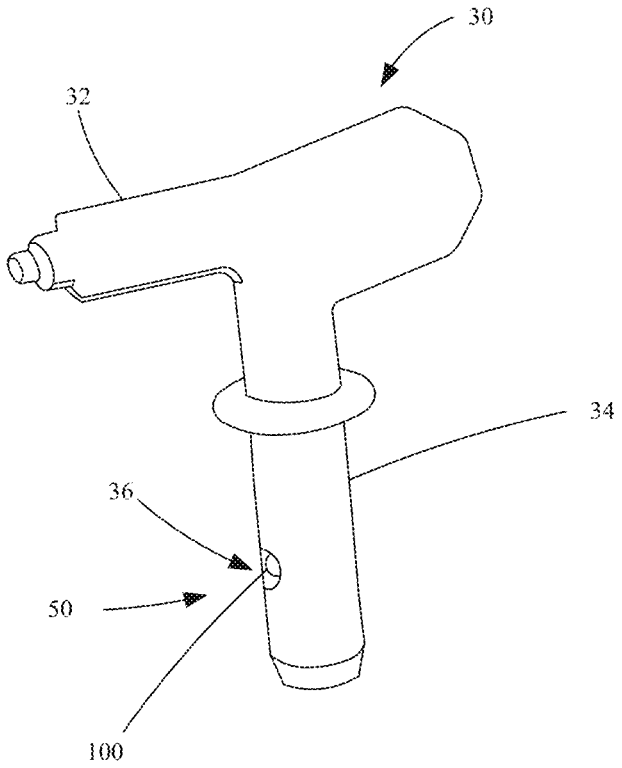
FIG. 3 is a perspective view showing one example spray tip assembly.

FIG. 3 is a perspective view showing an example spray tip assembly 30. Spray tip assembly 30 includes flag 32, tip stem 34, and receiving channel 36. Flag 32 can be coupled to tip stem 34 in various ways including, for example, but not by limitation, press fitting flag onto tip stem 34 or over molding flag 32 onto tip stem 34. Flag 32 provides a convenient surface for handling spray tip assembly 30, particularly when spray tip assembly 30 is installed in an applicator and can be used to indicate the directionality of spray tip assembly 30. For example, as previously mentioned, tip assembly 30 can be reversible (e.g., rotatable about its longitudinal axis) from a regular operating orientation (shown in FIG. 2) wherein the outlet of the spray tip faces aways from the spray gun and a cleaning operating orientation wherein the outlet of the spray tip faces towards the spray gun. Flag 32 can comprise various materials, for example, polymer. Tip stem 34 can comprise various materials, for example, metal such as stainless steel. A receiving channel 36 can be provided through tip stem 34, such as by machining, cutting, etc. The receiving channel 36 extends a distance between a front of spray tip assembly 30 and a rear of spray tip 30. In some examples, the receiving channel 36 may extend from a front of spray tip assembly 30 to a rear of spray tip assembly 30 and yet, in other examples, the receiving channel 36 may extend some other distance.

Figure 4:
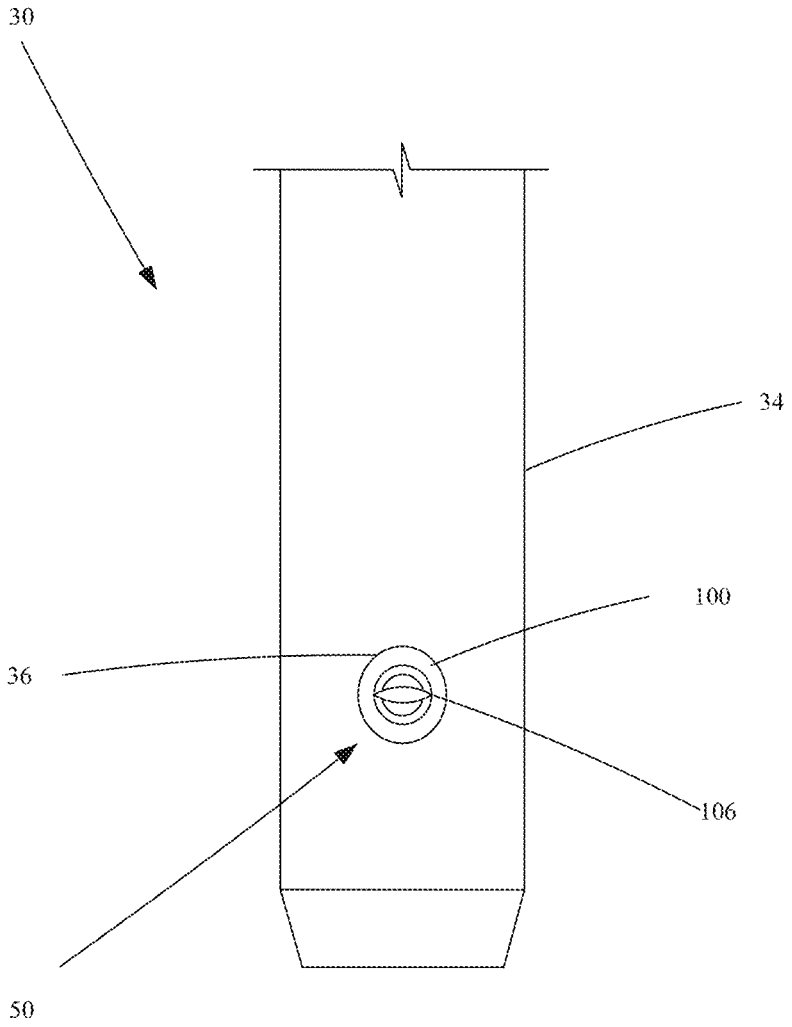
FIG. 4 is a partial front view showing one example spray tip assembly.

FIG. 4 is a partial front view showing one example spray tip assembly 30. As illustrated in FIG. 4, a spray tip (or tip piece) 100 (or another spray tip (or tip piece) such as spray tip (or tip piece) 1100 shown below) can be placed and retained within receiving channel 36. As will be shown in more detail in figures below, various other items can be placed and retained withing a receiving channel of a spray tip assembly.

Figure 5:
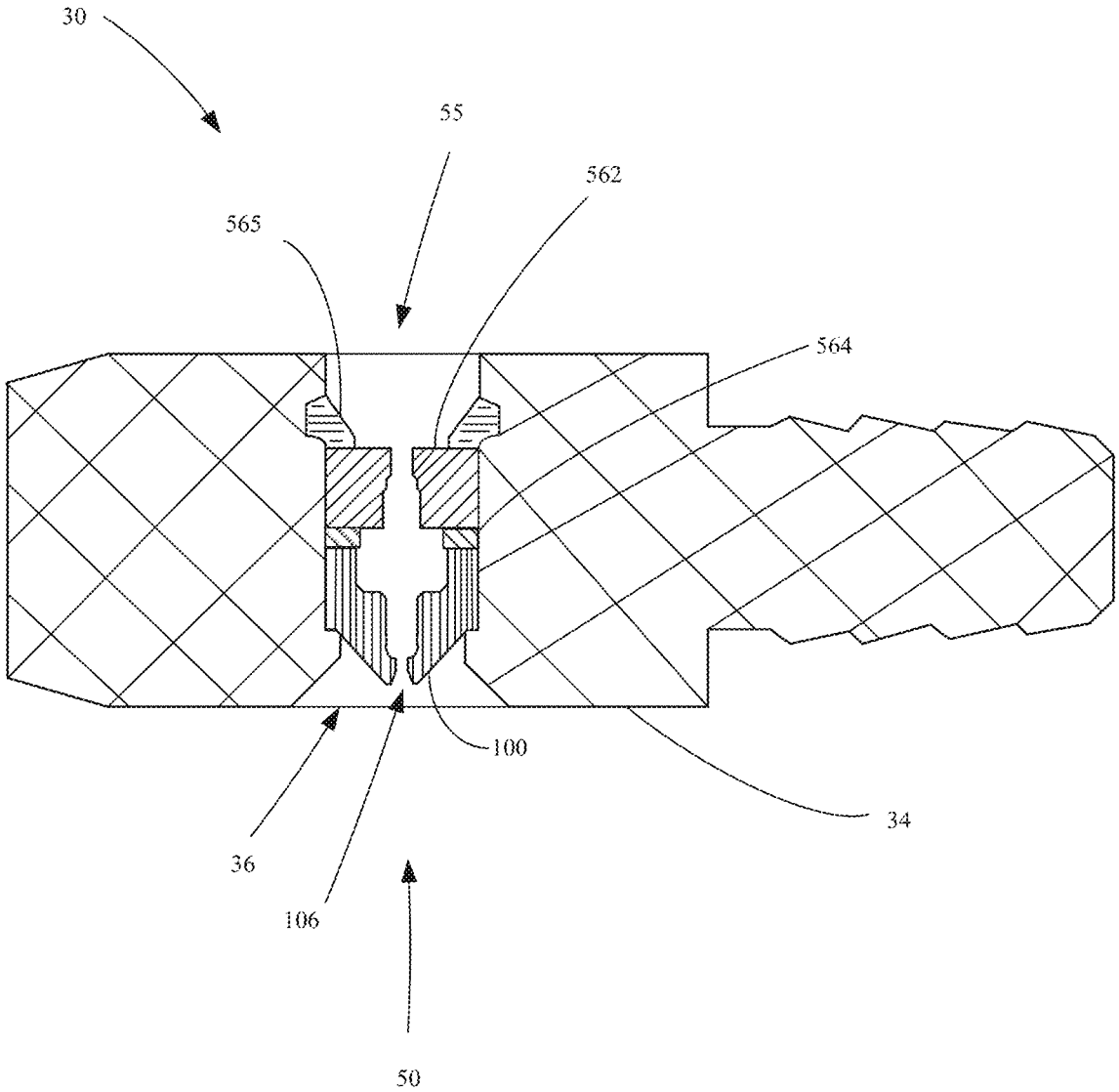
FIG. 5 is a cross-sectional view showing one example spray tip assembly.

FIG. 5 is a cross-sectional view of spray tip assembly 30. As illustrated in FIG. 5, spray tip assembly 30 further includes a pre-orifice piece 562, a sealing element 564, and a retaining ring 565 are disposed within the receiving channel 36 along with and upstream of spray tip 100 (or another spray tip, such as spray tip 1100). Further, as shown in FIG. 5, receiving channel extends between outlet 50 and inlet 55. Flag 32 is not shown in FIG. 5. It will be understood that the example spray tip assembly 30 shown in FIG. 5 is merely one example. Other example spray tip assemblies including a spray tip 100 (or another spray tip such as spray tip 1100) are contemplated herein.

It will be understood that the example spray tip assembly 30 shown in FIG. 5 is merely one example. In other examples, a spray tip assembly can vary from the example shown in FIG. 5. For instance, in one example, a spray tip assembly can include, as a pre-orifice piece, a pre-orifice element that is an integrated part of the tip stem body. Additionally, or alternatively, retaining elements, such as 565 and a shoulder (against which the spray tip is shown being disposed against in FIG. 5) need not be included, instead, the internal components of the spray tip assembly (e.g., one or more of spray tip, sealing element, and pre-orifice element), can be retained withing the receiving channel in various other ways, such as, friction fit, filler metal (e.g., brazing, solder, etc.), as well as other ways. Additionally, or alternatively, a spray tip assembly need not include some elements shown in FIG. 5, for instance, some example spray tip assemblies may not include a sealing element or a pre-orifice element, or both.

Figure 6:
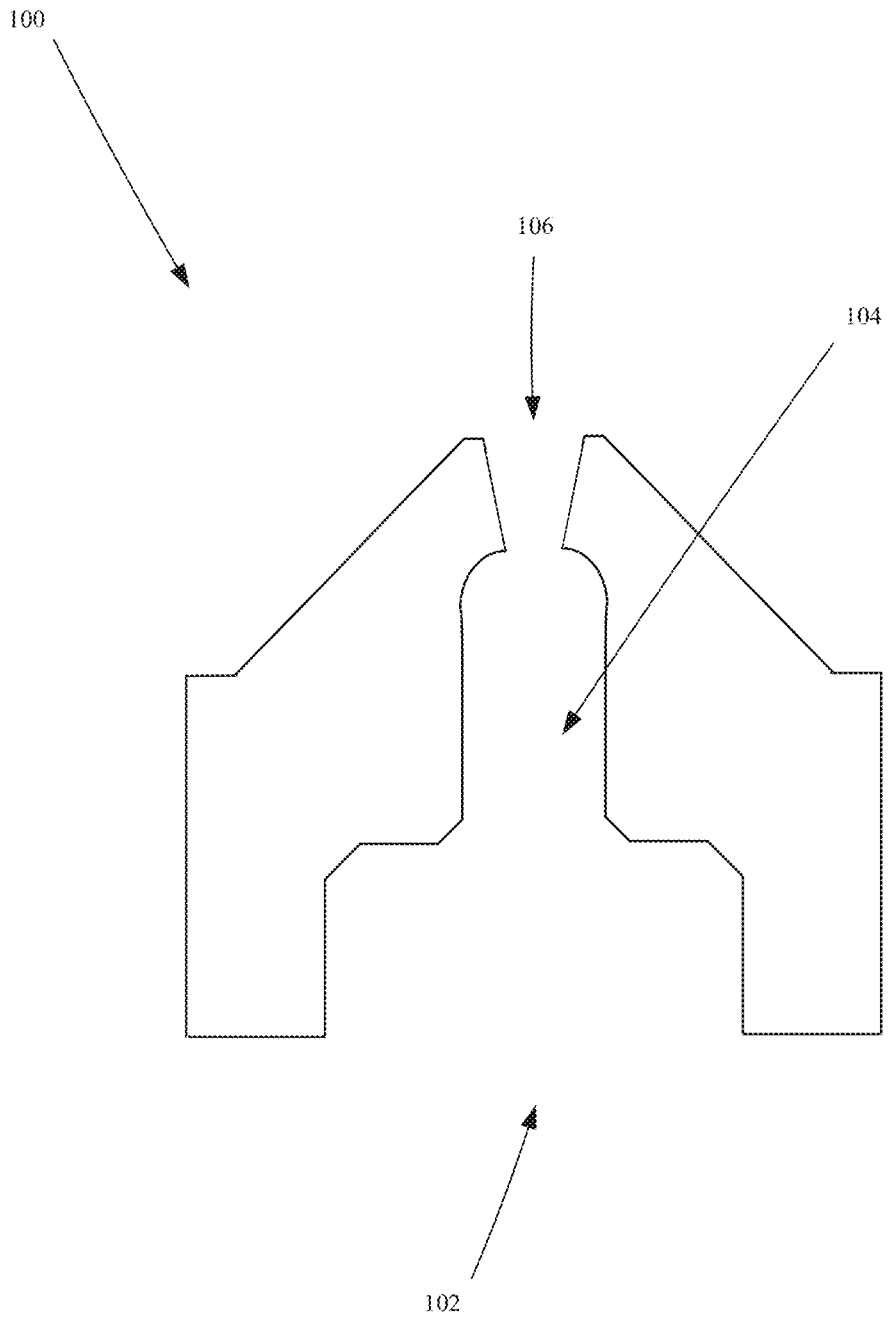
FIG. 6 is a cross-sectional view showing one example spray tip.

FIG. 6 is a cross-sectional view showing one example spray tip 100. As can be seen in FIG. 6, spray tip 100 includes inlet 102, internal geometry 104, and outlet 106. Internal geometry 104 includes dome 105, approach diameter 107, and can include other item(s) as shown. Fluid enters spray tip 100 via inlet 102 and exits spray tip 100 via outlet 106. While a given internal geometry 104 is shown in FIG. 1, it will be understood that in other examples, spray tip 100 can include other internal geometries. Outlet 106, as shown in FIGS. 4-6, is sometimes referred to as a "cat eye."

In some examples, the spray tip 100 shown in FIG. 6 can be an unfinished spray tip that is further processed to generate a wear-mimicking surface (or geometrical feature).

Figure 7:
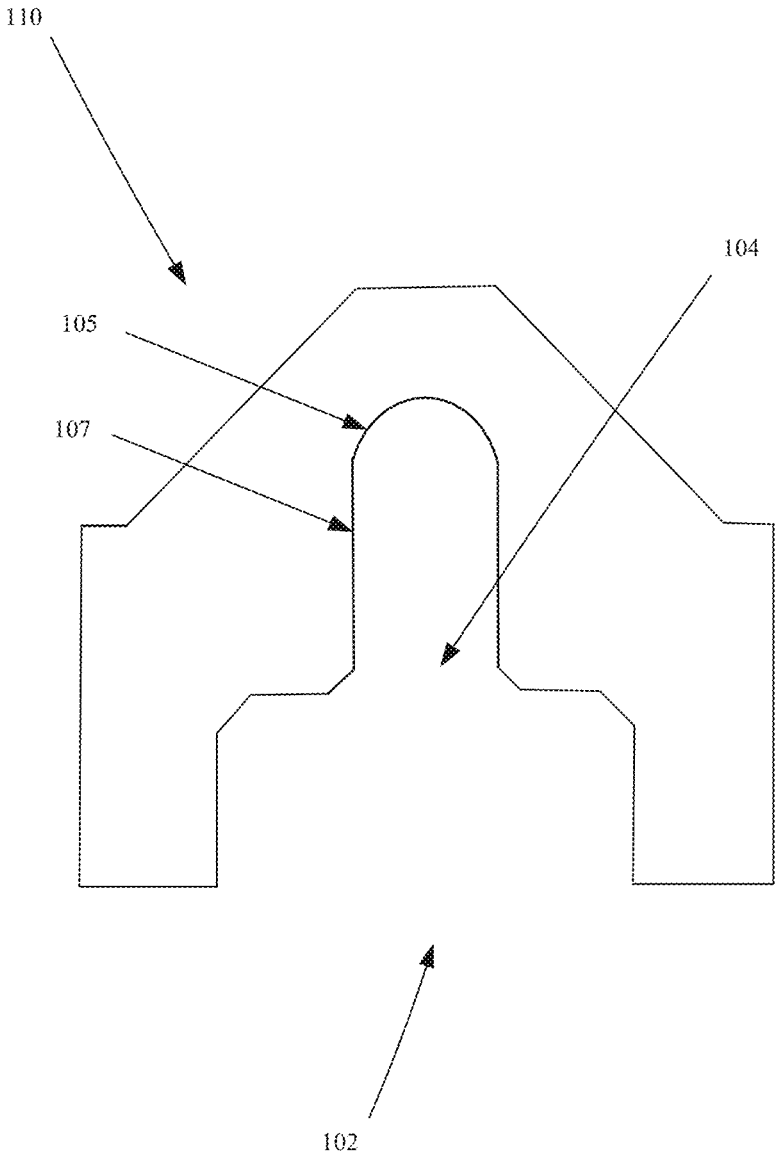
FIG. 7 is a cross-sectional view showing one example unfinished spray tip.

FIG. 7 is a cross-sectional view showing one example unfinished spray tip 110 (a spray tip blank). As illustrated in FIG. 7, unfinished spray tip 110 includes inlet 102 and internal geometry 104, but does not include an outlet, such as outlet 106. Unfinished spray tip 110 can be produced by pressing carbide powder (e.g., tungsten carbide powder). Generally, the carbide powder is placed (e.g., poured) into a press cavity (e.g., a die) and then a ram (or press) is provided into the press cavity and compresses the powder to form the unfinished spray tip 110. Once the powder is fully pressed, the ram is withdrawn from the cavity. The formed unfinished spray tip 110 can then be removed from the press cavity. In some current systems, the unfinished spray tip 110 is then ground with a diamond grinder wheel to cut an outlet into the unfinished spray tip 110 as part of producing a finished spray tip.

Figure 8:
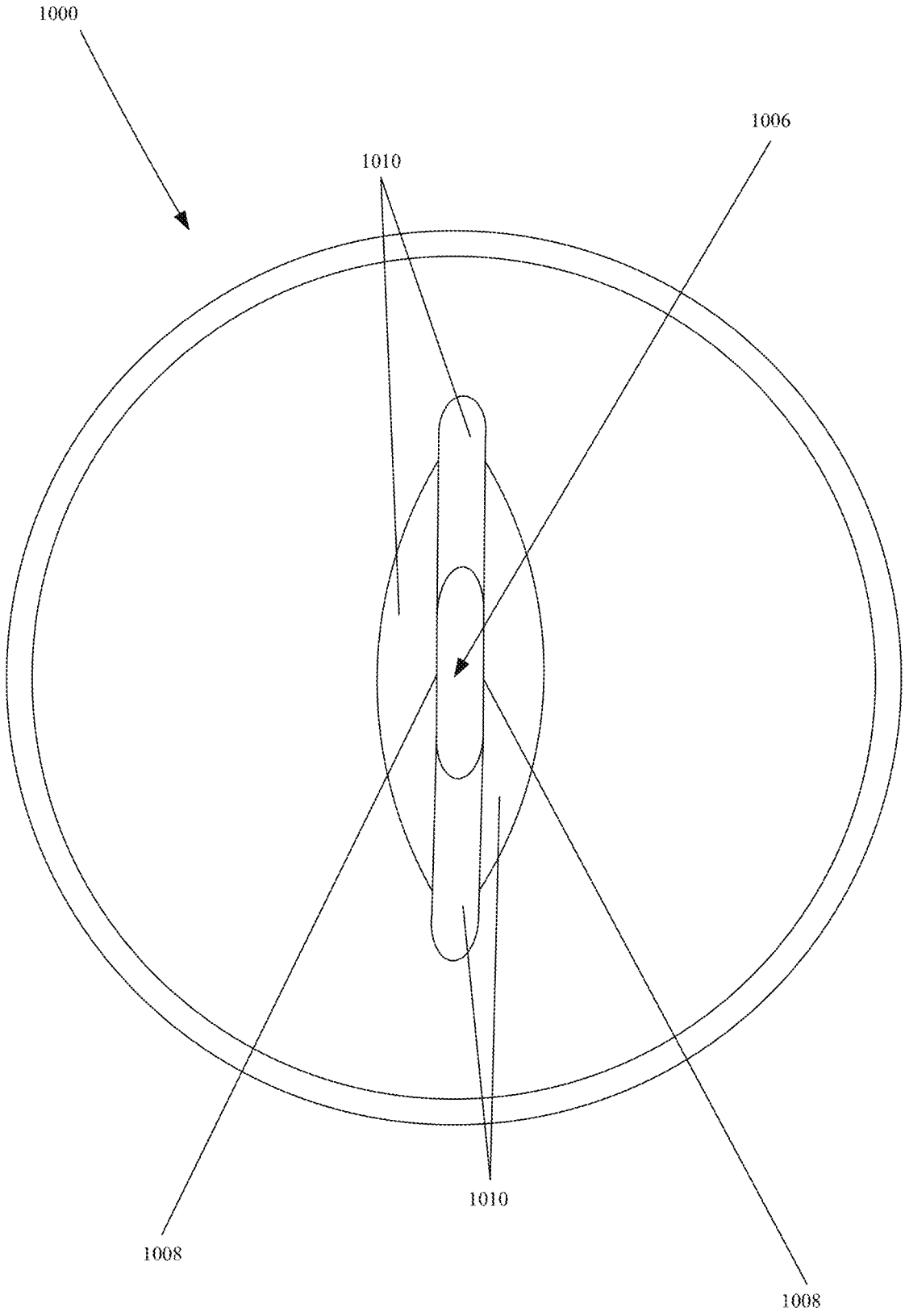
FIG. 8 is a top view showing one example spray tip having an outlet produced by grinding.

FIG. 8 is a top view showing one example of a spray tip 1000. As can be seen in FIG. 8, spray tip 1000 is conical. Spray tip 1000 is produced by grinding unfinished spray tip 110 at approximately the center of unfinished spray tip 110 (or the top of the conical body) to form an outlet 1006. Outlet 1006 is a "cat eye" outlet. As can be seen, the grinding process produces a track 1010 in portions of spray tip 1000 surrounding outlet 1006. The track 1010 represents the pathway of the grinding wheel and also the additional material removed by the grinding wheel. The grinding process further produces sharp edges 1008 of outlet 1006. Additionally, as can be seen, the outlet 1006 has a geometry that corresponds to, and is thereby limited to, the cross-section of the grinding wheel used to produce the outlet 1006.

Figure 9:
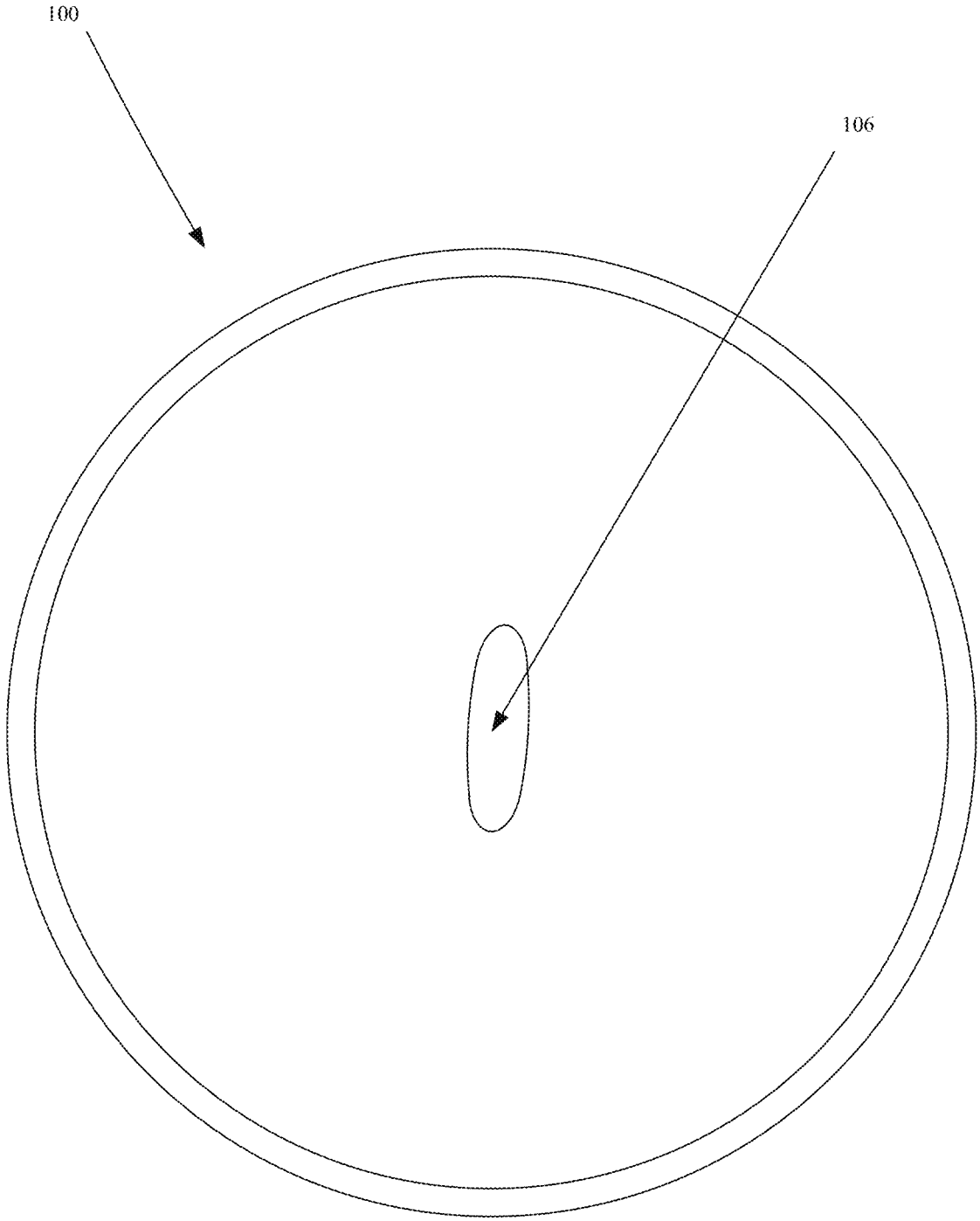
FIG. 9 is a top view showing one example spray tip having an outlet produced by laser ablation.

FIG. 9 is a top view of spray tip 100. Spray tip 100 is, in one example, produced by laser ablating unfinished spray tip 110 to form outlet 106. As can be seen, spray tip 100 does not have a track, like track 1010 of spray tip 1000. Additionally, the outlet 106 does not have sharp edges, like sharp edges 1008 of outlet 1006. Rather, in the example shown in FIG. 9, outlet 106 has more curvature than outlet 1006. An outlet formed by laser ablation is not limited in geometry in the same way that the geometry of an outlet formed by grinding is limited. Laser ablation allows for more flexibility with regard to outlet geometry as compared to the geometry allowed by grinding. For example, various geometries could be selected and produced by use of laser ablation, beyond the example shown in FIG. 9, that would not be possible with grinding. For example, a variety of arbitrary additional outlet features could be provided by laser ablation. The inclination angle of the laser could be changed to provide geometries of different angles. Additionally, laser ablation could be utilized to form an outlet having shapes other than the cat-eye shape shown in FIG. 9.

Additionally, it will be noted that the grinding process can, in some instances, break off tiny pieces of the sharp edge of the outlet 1006. This can lead to unintended and undesirable fluid dynamics (e.g., unintended and undesirable spray pattern) or may require the scrapping of the spray tip 1000 altogether. Laser ablation has zero cutting force and thus is less likely to break off tiny pieces of the edge of the outlet 106. Accordingly, laser ablation results in less waste and more consistently produces spray tips as desired.

Further, in the forming of the outlet, the laser could be caused to impinge on the spray tip from the upstream end of the spray tip or from the downstream end of the spray tip, or both.

Figure 10A:
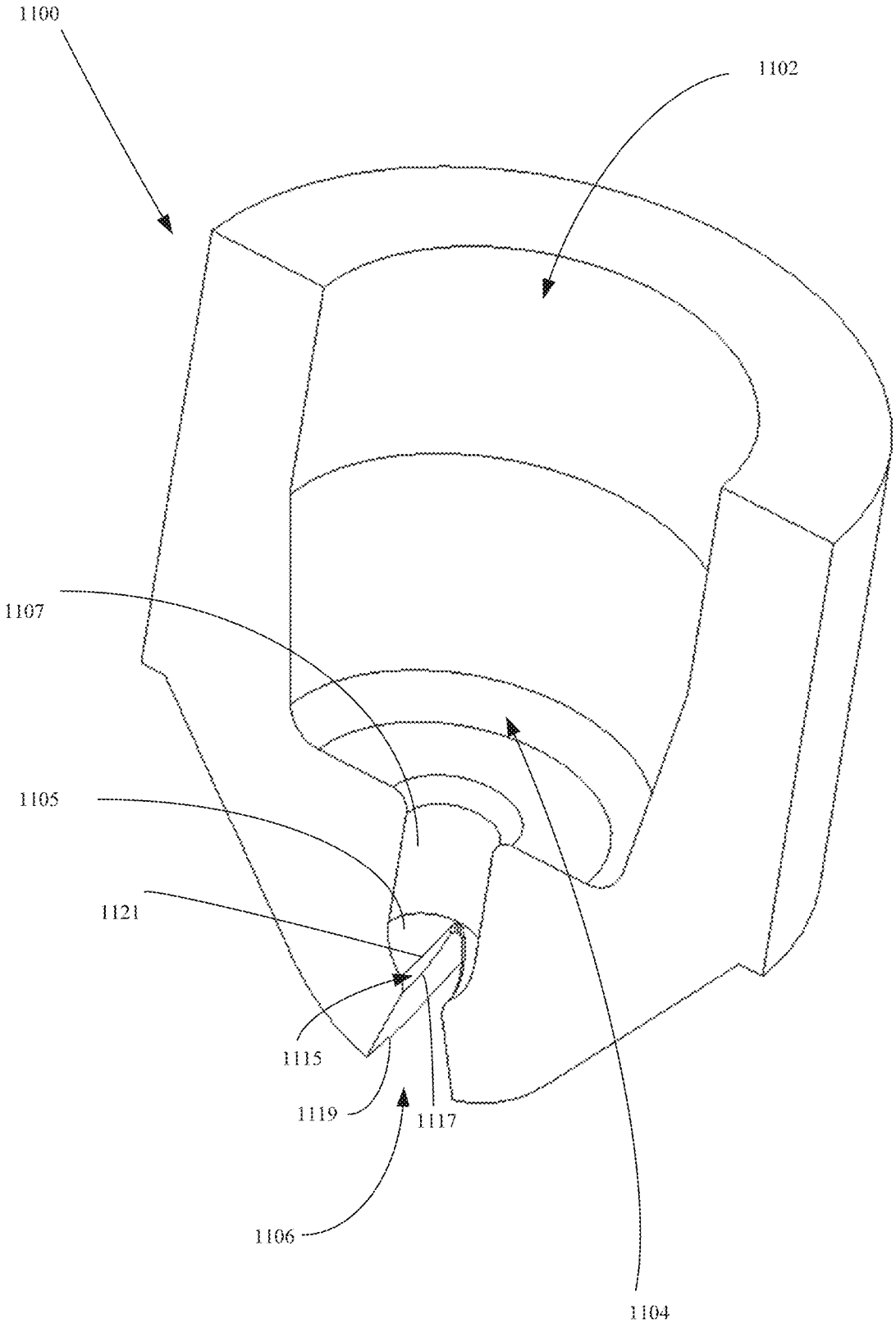
FIGS. 10A-10B (collectively referred to herein as FIG. 10) are cross-sectional views showing one example spray tip having a manufactured wear-mimicking surface.
Figure 10B:
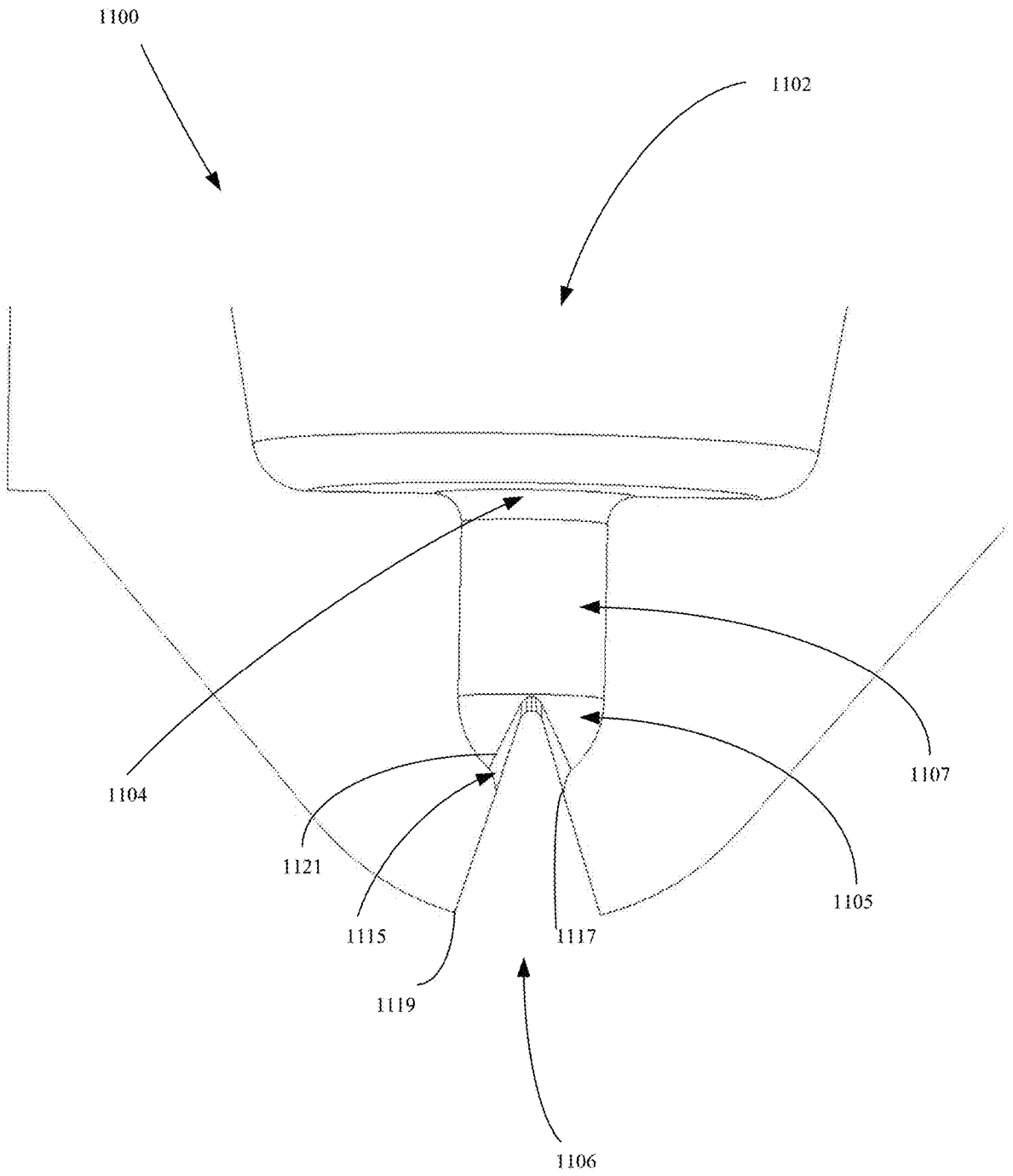

FIGS. 10A-10B (collectively referred to herein as FIG. 10) are cross-sectional views showing one example spray tip 1100. As can be seen in FIG. 10, spray tip 1100 includes inlet 1102, internal geometry 1104, outlet 1106, wear-mimicking surface (or wear-mimicking geometrical feature) 1115. Internal geometry 1104 itself includes dome 1105 and approach diameter 1107, and also includes other items, as shown. Spray tip 1100 can be produced in a variety of ways.

For example, an unfinished spray tip, such as unfinished spray tip 110, could be grinded or laser ablated to form outlet 1106. The wear-mimicking surface 1115 can then be formed by laser-ablation, sandblasting, hydroerosive machining (or grinding), or in other ways. In another example, an unfinished spray tip, such as an example in which spray tip 100 is an unfinished spray tip, could be generated (such as by pressing) and the wear-mimicking surface 1115 can then be formed by laser-ablation, sandblasting, hydroerosive machine (or grinding), or in other ways.

In another example, spray tip 1100 can be produced by pressing (e.g., pressing carbide powder, such as tungsten carbide powder) as described above.

The spray tip 1100, in one example, when manufactured by pressing could include outlet 1006 and the wear-mimicking surface 1115. Thus, in one example, the entirety of the spray tip 1100, as shown in FIG. 10, could be formed by pressing. In such an example, the die could include geometry to form the wear-mimicking surface 1115 (as well as the other features of the spray tip 1100).

Figure 11:
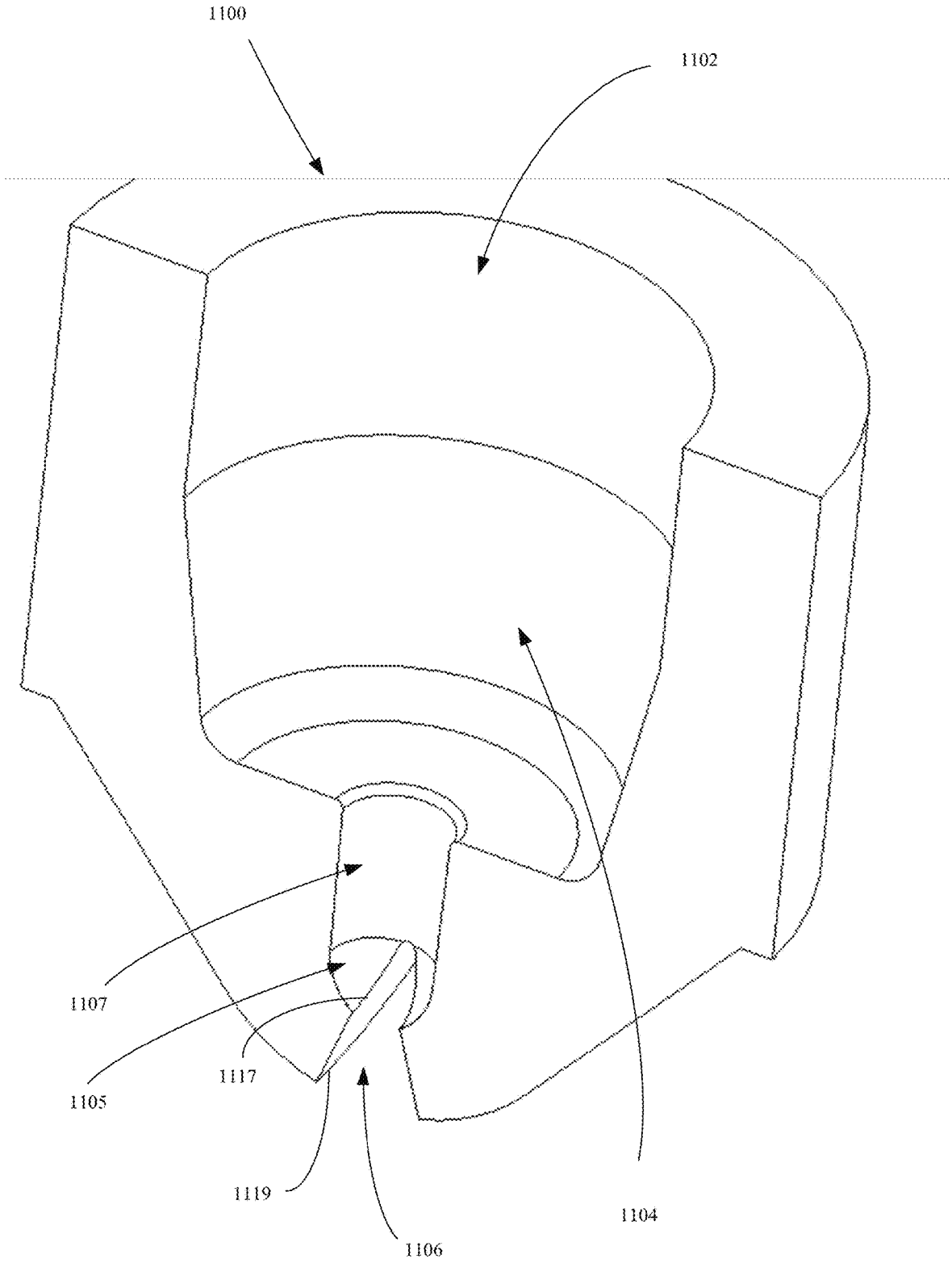
FIG. 11 is a cross-sectional view showing one example unfinished spray tip.

In another example, the spray tip 1100, when manufactured by pressing, could include outlet 1006 (as well as other items of spray tip 1100) but not include the wear-mimicking surface 1115. One example of this is shown in FIG. 11. In such an example, the wear-mimicking surface 1115 can be formed by laser-ablation, sandblasting, hydroerosive machining (or grinding), or in other ways. Where laser-ablation is utilized, the laser can impinge on the spray tip 1100 from the upstream end (i.e., end including the inlet 1102), opposite the downstream end (i.e., end including the outlet 1106).

Laser-ablation may be advantageous over sandblasting, hydroerosive machining (or grinding), and other manufacturing techniques for producing the wear-mimicking surface 1115 as laser-ablation allows for more precise control and thus, may be less prone to error.

As can be seen, wear-mimicking surface 1115 is an internal geometrical feature of spray tip 1100. Wear-mimicking surface 1115 extends around (surrounds) an inner perimeter 1117 of outlet 1106 (opposite outer perimeter 1119 of outlet 1106) and extends radially away from the inner perimeter 1117 of outlet 1106, in a plurality of directions. The wear-mimicking surface 1115 extends between the inner perimeter 1117 of outlet 1106 and dome 1105. It can be seen that wear-mimicking surface 1115 is of varying width (the distance extending from the inner perimeter 1117 to the perimeter 1121 of wear-mimicking surface 1115). As can be seen, wear-mimicking surface 1115 is generally thinner or narrower (i.e., of less width) at the corners of the outlet 1106 (e.g., at each canthus of a cat-eye outlet) as compared to the width at other portions along inner perimeter 1117 of the outlet 1106, such as the width at the middle of the inner perimeter 1117 of outlet 1106. Thus, wear-mimicking surface 1115 is non-symmetrical and cannot be produced by a machining tool such as a lather. It can also be seen that wear-mimicking surface 1115 has a slope such that perimeter 1121 is offset (e.g., laterally offset) from inner perimeter 1117. Additionally, it can be seen that wear-mimicking surface 1115 has an area that is less than an area of dome 1105.

FIG. 11 is a cross-sectional view showing one example unfinished spray tip 1110. As illustrated in FIG. 11, unfinished spray tip 1110 includes inlet 1102, internal geometry 1104, and outlet 1106, but does not include wear-mimicking surface 1115. Unfinished spray tip 1110 can be produced by a pressing process, such as a pressing process with carbide powder (e.g., tungsten carbide power). Generally, the carbide powder is placed (e.g., poured) into a press cavity (e.g., a die) and then a ram (or press) is provided into the press cavity and compresses the powder to form a compact of the unfinished spray tip 1110. Once the powder is fully pressed, the ram is withdrawn from the cavity. The formed compact of the unfinished spray tip 1110 can then be removed from the press cavity and sintered to produce the formed unfinished spray tip 1110. The formed unfinished spray tip 1110 can then be further processed to form wear-mimicking surface 1115 (e.g., by laser-ablation, hydroerosive machine (or grinding), sandblasting, etc.) and to generate spray tip 1100.

Figure 12:
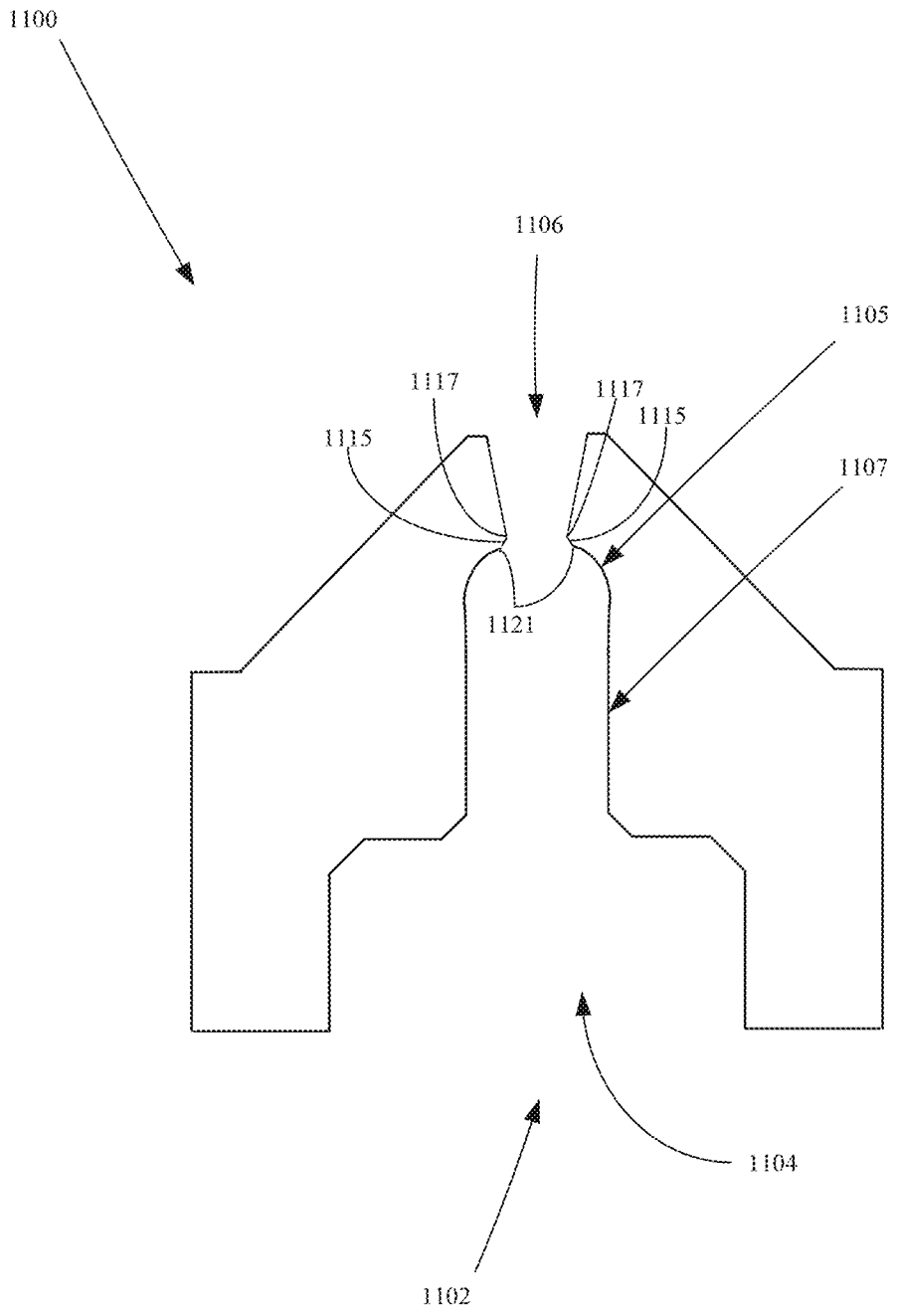
FIG. 12 is a cross-sectional view showing one example finished spray tip.

FIG. 12 is a cross-sectional view showing one example spray tip 1100. As illustrated in FIG. 12, finished spray tip 1100 includes inlet 1102, internal geometry 1104, outlet 1106, and wear-mimicking surface 1115.

Figure 13:
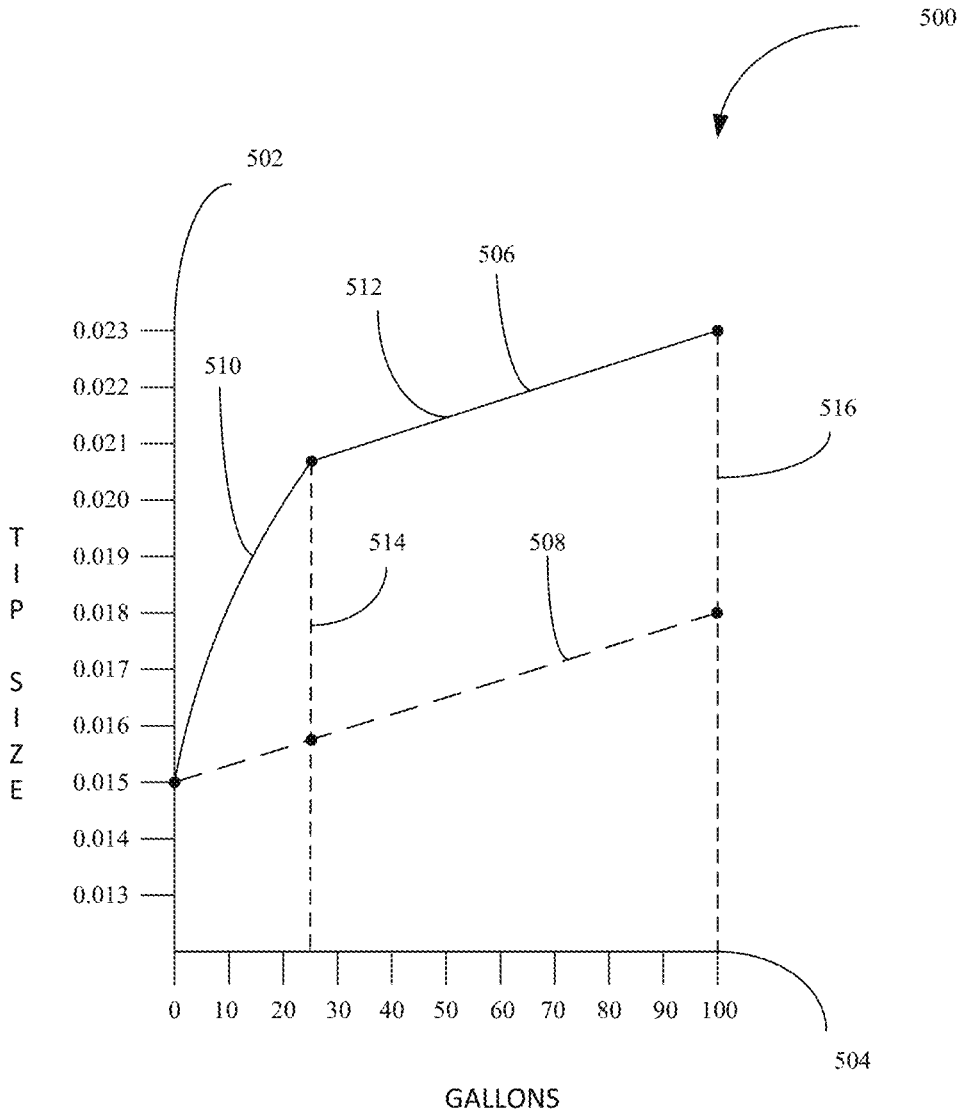
FIG. 13 is a graphical view showing one example wear curve graph.

FIG. 13 is a graphical illustration showing one example wear-curve graph 500. Wear-curve graph 500 includes Y-axis 502, X-axis 504, line 506, line 508, portion 510, portion 512, line 514, and line 516. Y-axis 502 plots tip orifice size in inches (thousandths of an inch). X-axis 504 plots an amount of fluid (e.g., paint) sprayed through the spray tip in gallons. Thus, the wear curve (or wear rate) generally tracks changes in tip orifice size as the volume of fluid sprayed changes, or, said another way, the change (e.g., increase) in tip orifice per volume. Line 506 shows the projected wear curve, and thus, the projected wear rate, of a spray tip that does not include an as-manufactured wear-mimicking surface, such as as-manufactured wear-mimicking surface 1115. It can be seen that the projected wear curve, indicated by line 506, is generally non-linear (or at least less linear than the wear curve indicated by line 508). Further, it can be seen that the projected wear curve indicated by line 506 includes a first portion 510 corresponding to an initial use period. The initial use period is indicated by line 514 and is approximately the first 25 gallons of material sprayed through the spray tip corresponding to line 506 by an end user. Additionally, as can be seen, line 506 includes a second portion, corresponding to a subsequent use period that follows the initial use period. While the example shown in FIG. 13 only extends out to one hundred gallons, it will be understood that this is for illustrative purposes only. It will be understood that the use of spray tips can go beyond one hundred gallons, Line 508 shows the projected wear curve and thus, the projected wear rate of a spray tip that includes an as-manufactured wear-mimicking surface, such as manufactured wear-mimicking surface 1115. As can be seen, the spray tip corresponding to line 506 wears more quickly than the spray tip corresponding to line 508, particularly in the initial use phase (e.g., the first 25 gallons). It can be seen that the projected wear rate of the spray tip corresponding to line 506 flattens (becomes more linear) after the initial use phase. It can be seen that the projected wear rate of the spray tip corresponding to line 508 is generally linear throughout its use. Thus, the wear curve, indicated by line 508, is more linear than the wear curve indicated by line 506 and thus, a manufactured spray tip having a manufactured wear-mimicking surface, such as manufactured wear-mimicking surface 1115, has a more linear wear curve than a wear curve of a spray tip without a manufactured wear-mimicking surface, such as manufactured wear-mimicking surface 1115.

It will be understood that the term projected, with reference to projected wear curve or projected wear rate, is used to indicate that it is the estimated wear curve or wear rate as manufactured and before use or operation by an end user.

Figure 14:
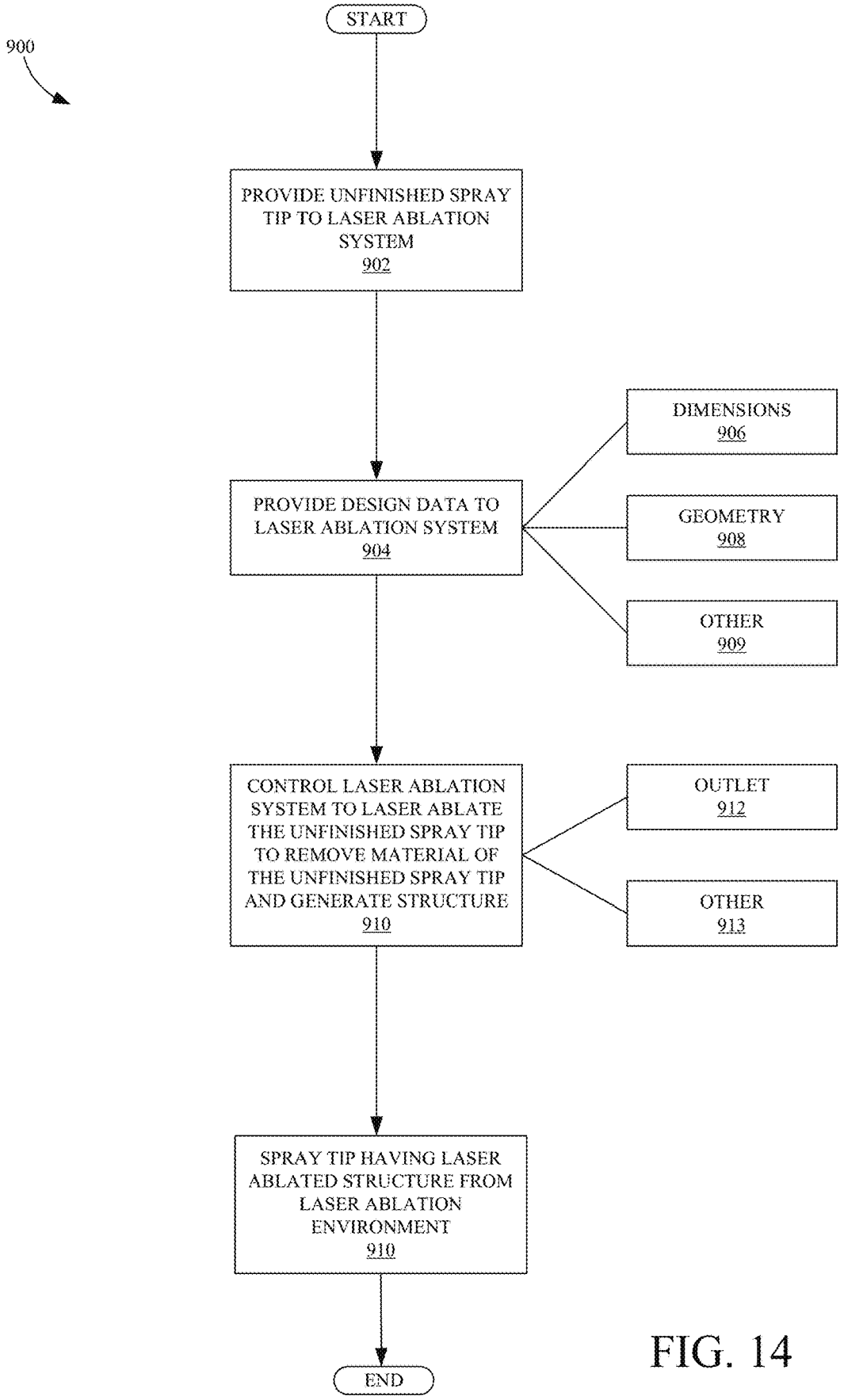
FIG. 14 is a flow chart showing one example manufacturing operation of producing a spray tip having laser-ablated structure(s).

FIG. 14 is a flow chart showing one example of spray tip manufacture in accordance with one embodiment. Method 900 begins at block 902 where an unfinished spray tip, such as unfinished spray tip 110, is provided into a laser ablation environment. Generally, a laser ablation environment includes a laser ablation system (e.g., a laser and associated items), an enclosure, and a platform upon which the unfinished spray tip 110 is placed and secured. One example laser ablation system is sold under the trade designation TruLaser Cell 3000 by TRUMPF Inc. of Farmington, CT. Another example laser ablation system can be manufactured by Precision MicroFab LLC of Curtis Bay, MD.

At block 904, design data is provided to the laser ablation system. The design data defines (or describes) the dimensions of the unfinished spray tip and the dimensions of the finished spray tip, as indicated by block 906. It will be understood that the dimension information can define (or describe) not only the size of items of the spray tip, but also their location on the spray tip or their location relative to other items of the spray tip. The design data further defines (or describes) the geometry of the unfinished spray tip and the geometry of the finished spray tip, including the internal geometry (e.g., 104) as well as the geometry of the outlet (e.g., 106), as indicated by block 908. The design data can define (or describe) various other information as well, as indicated by block 909.

At block 910, the laser ablation system is controlled, based on the design data, to laser ablate the unfinished spray tip and remove material from the unfinished spray tip to generate structure of a spray tip. The structure can include an outlet, such as outlet 106, as indicated by block 912. Additionally, or alternatively, the structure can include various other items, as indicated by block 913, such as other apertures, holes, or geometries. At block 910, the position of laser pulses, inclination angle of laser pulses, intensity of laser pulses, duration of laser pulses, and duration at location of the laser pulses generated by the laser ablation system as well as other operating parameters of the laser or the laser ablation system can be controlled based on the design data.

At block 914, the spray tip having the laser ablated structure is removed from the laser ablation environment.

It will be noted that further processing on the spray tip may occur after or before the production of the structure(s) by laser ablation.

Figure 15:
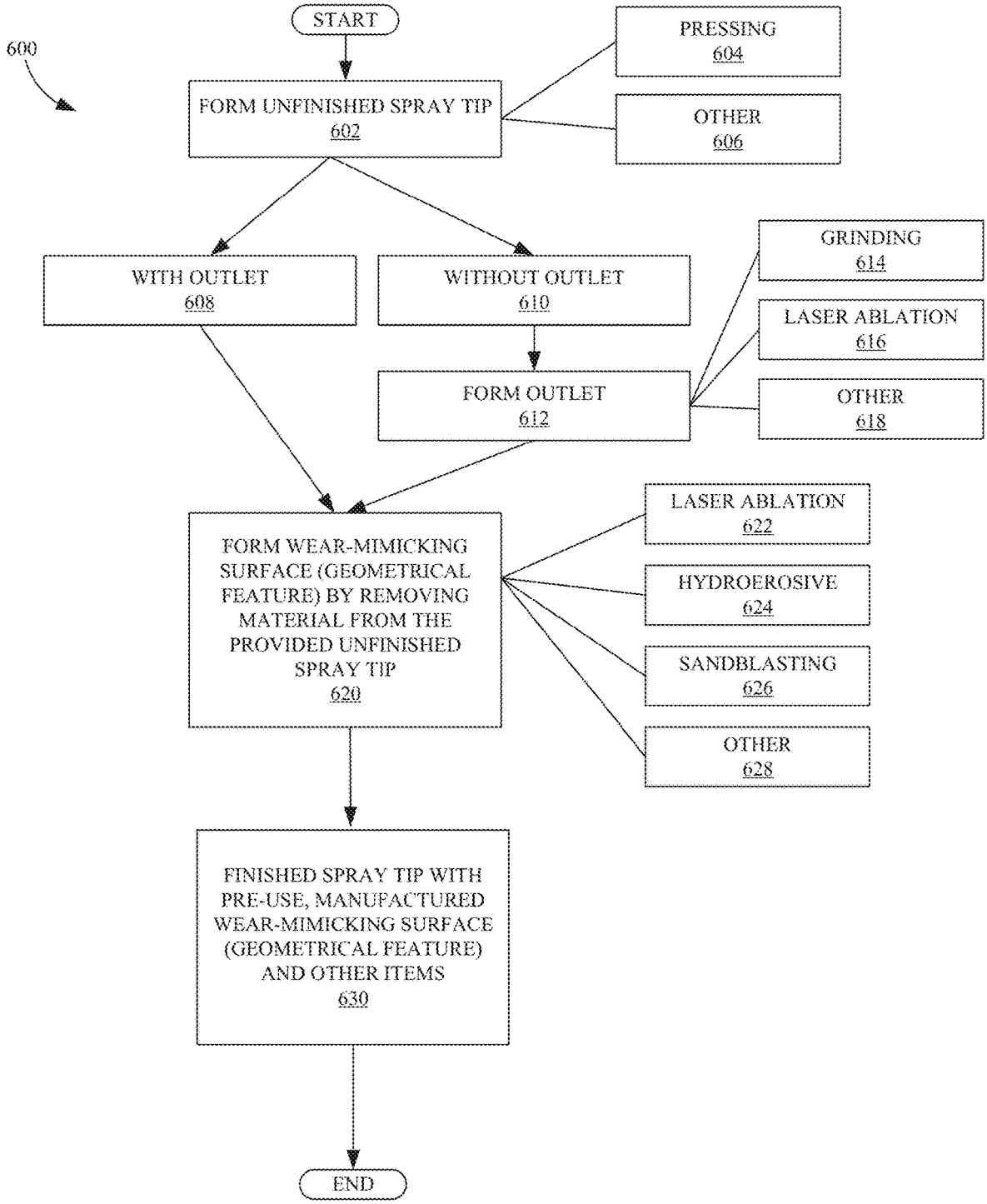
FIG. 15 is a flow chart showing one example manufacturing operation of producing a spray tip having a wear-mimicking surface.

FIG. 15 is a flow chart showing one example of spray tip manufacture in accordance with one embodiment. Manufacturing method 600 begins at block 602 where an unfinished spray tip is formed. Forming the unfinished spray tip can, in one example, include a pressing process as indicated by block 604. For example, carbide powder (e.g., tungsten carbide powder) can be provided and placed into a press cavity (e.g., a die, etc.) and then a ram (or press or punch) is provided into the press cavity to compress the powder to form a compact of the unfinished spray tip. The compact of the unfinished spray tip can then be sintered to form the unfinished spray tip. The unfinished spray tip can be formed in various other ways, as indicated by block 604.

As previously described, an unfinished spray tip formed at block 602 can include a variety of features including inlet (e.g., 1102, etc.), internal geometry (e.g., 1104, etc.), and outlet (e.g., 1106, etc.). In some examples, an unfinished spray tip formed at block 602 does include an outlet, as indicated by block 608, in which case method 600 proceeds to block 620. In some examples, an unfinished spray tip formed at block 602 does not include an outlet, as indicated by block 610, in which case method 600 proceeds to block 612.

At block 612, an outlet (e.g., 1106, etc.) is formed in the unfinished spray tip from block 610. In one example, the outlet is formed by grinding, as indicated by block 614. Grinding can include grinding with a grinder wheel (e.g., diamond grinder wheel) to cut an outlet into the unfinished spray tip. In one example, the outlet is formed by laser ablation, as indicated by block 616. One example of forming an outlet by laser ablation is described in FIG. 14. An outlet can be formed in the unfished spray tip in various other ways, as indicated by block 618.

Either from block 608 or 612, method 600 proceeds to block 620. At block 620, a wear-mimicking surface (or geometrical feature), such as wear-mimicking surface (or geometrical feature) 1115, is formed by removing material from the provided unfinished spray tip.

In one example, the wear-mimicking surface (or geometrical feature) is formed by laser ablation, as indicated by block 622. This can include providing the unfinished spray tip to a laser ablation system, such as the laser ablation system described in FIG. 14, and controlling the laser ablation system to laser ablate the unfinished spray tip and remove material from the unfinished spray tip to generate the wear-mimicking surface (or geometrical feature). Design data, describing the dimensions and geometry of the wear-mimicking surface (or geometrical feature) can be provided to the laser ablation system for use in controlling the laser ablation system to generate the wear-mimicking surface (or geometrical feature).

In one example, the wear-mimicking surface (or geometrical feature) is formed by hydroerosive machining (or grinding), as indicated by block 624. This can include pumping abrasive fluid under pressure against and through the internal geometry of the unfinished spray tip and the outlet. The abrasive fluid is a slurry mixture that comprises a carrier (e.g., oil or aqueous medium) and abrasive particles finely distributed within the carrier. Thus, the abrasive fluid is a suspension. The abrasive fluid is different than the fluids sprayed through the spray tip by an end user.

In one example, the wear-mimicking surface (or geometrical feature) is formed by sandblasting, as indicated by block 626. This can include forcibly propelling (e.g., with pressurized (e.g., compressed) air) abrasive solid particles against and through the internal geometry and outlet of the unfinished spray tip. The abrasive solid particles are different than the fluids sprayed through the spray tip by an end user.

The wear-mimicking surface (or geometrical feature) can be formed in various other ways, as indicated by block 628.

The processing at block 620 results in a finished spray tip having a pre-use (prior to use by an end-user), manufactured (formed during the manufacturing process) wear-mimicking surface (or geometrical feature), such as wear-mimicking surface (or geometrical feature) 1115, as well as other items (e.g., inlet, outlet, internal geometry, etc.), as indicated by block 630.

Figure 16:
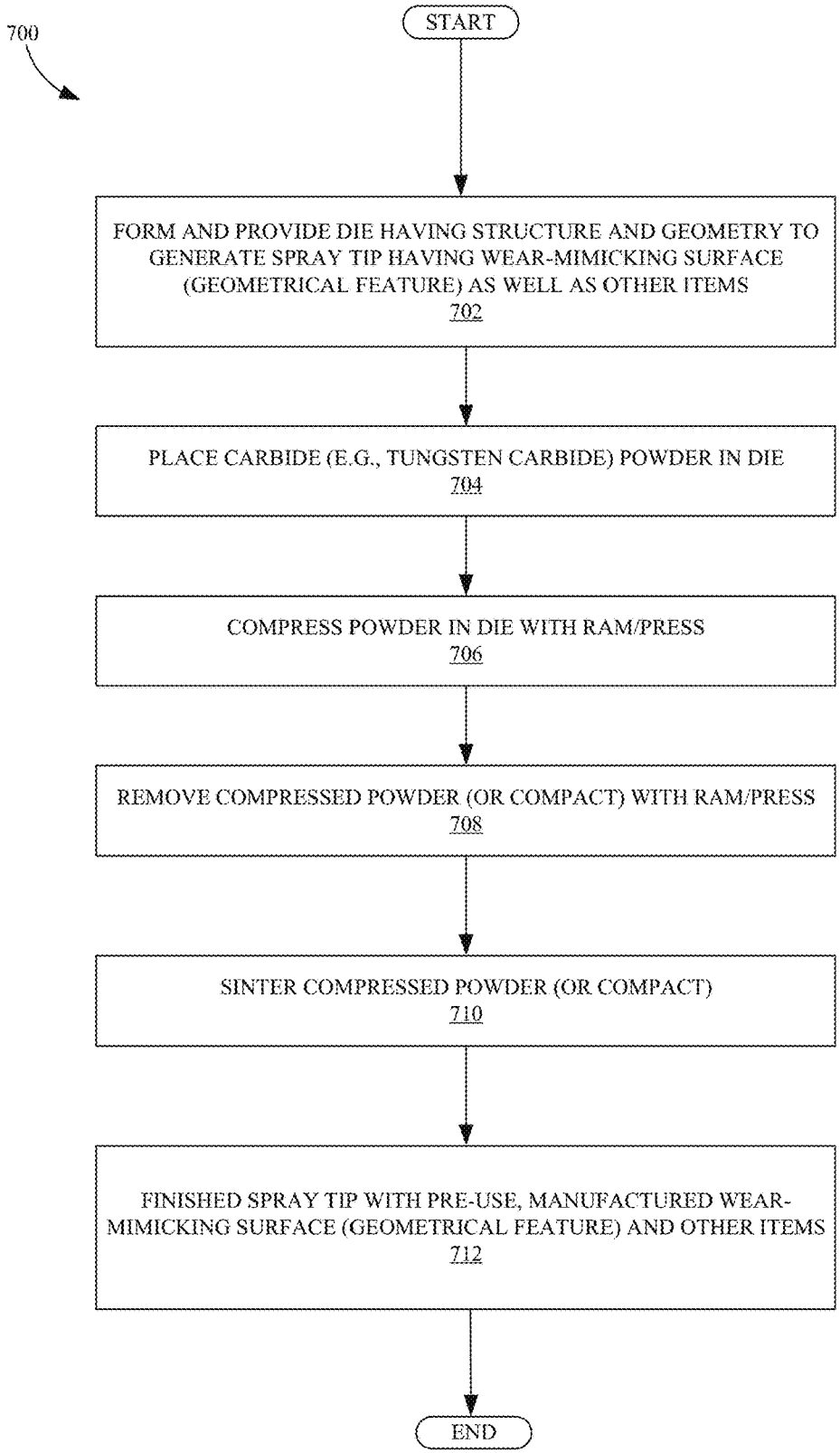
FIG. 16 is a flow chart showing one example manufacturing operation of producing a spray tip having a wear-mimicking surface.

FIG. 16 is a flow chart showing one example of spray tip manufacture in accordance with one embodiment. Manufacturing method 700 describes a pressing process. Manufacturing method 700 begins at block 702 where a die having structure and geometry to generate a spray tip having wear-mimicking surface (or geometrical feature), such as wear-mimicking surface (or geometrical feature) 1115, as well as other items (e.g., inlet, outlet, internal geometry, etc.) is formed and provided.

At block 704 carbide (e.g., tungsten carbide) powder is placed (e.g., poured) in the die from block 702.

At block 706 the powder in the die is compressed with a ram (also called a press or a punch).

At block 708 the compressed powder (also called a compact) is removed from the die with another ram (or press or punch). Generally, the ram (or press or punch) in block 706 is a top ram and the ram (or press or punch) at block 708 is a bottom ram.

At block 710 the compressed powder (or compact) goes through a sintering process to form a finished spray tip having wear-mimicking surface (or geometrical feature), such as wear-mimicking surface (or geometrical feature) 1115, as well as other items such as an inlet (e.g., 1102, etc.), an outlet (e.g., 1106), internal geometry (e.g., 1104), as well, in some examples, other items.

It will be understood by those skilled in the art that the powder pressing metallurgy manufacturing method described in FIG. 16 can include additional steps as well as various sub-steps to the steps described.

Figure 17:
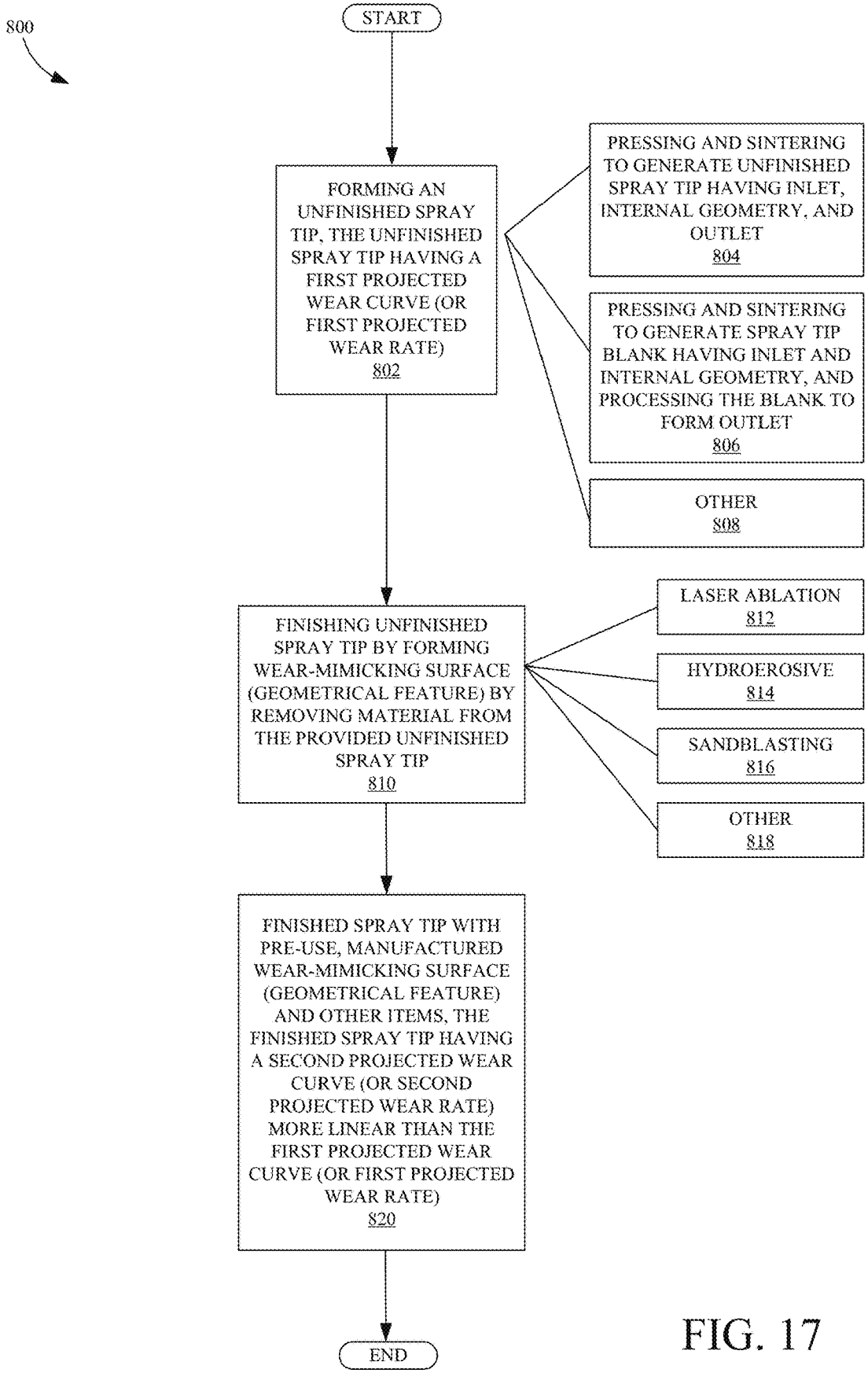
FIG. 17 is a flow chart showing one example manufacturing operation of producing a spray tip having a wear-mimicking surface.

FIG. 17 is a flow chart showing one example of spray tip manufacture in accordance with one embodiment. Manufacturing method 800 begins at block 802 where an unfinished spray tip is formed. The unfinished spray tip at block 800 does not include a manufactured wear-mimicking surface, such as manufactured wear-mimicking surface 1115. The unfinished spray tip at block 800 has a corresponding projected wear curve (or projected wear rate) that is non-linear. The corresponding projected wear curve (or projected wear rate) could be or could be similar to the projected wear curve (or projected wear rate) represented by line 506 in FIG. 13. The corresponding projected wear curve (or projected wear rate) has a first portion (e.g., such as the first portion 510 or another similar first portion) corresponding to an initial use period (e.g., such as the initial use period represented by line 514 or another initial use period). The corresponding projected wear curve (or projected wear rate) has a second portion (e.g., such as the second portion 512 or another similar second portion) corresponding to a subsequent user period (e.g., such as the subsequent use period represented by line 516 or another subsequent use period). The second portion is more linear than the first portion.

In one example, as indicated by block 804, forming the unfinished spray tip can include pressing and sintering to generate an unfinished spray tip including an inlet (e.g., 1102, etc.), internal geometry (e.g., 1104, etc.), an outlet (e.g., 1106, etc.), as well as other items. For example, a press cavity (e.g., a die, etc.), having geometry to generate the inlet, the outlet, and the internal geometry can be provided. Carbide powder (e.g., tungsten carbide powder) can be provided and placed into the press cavity (e.g., die, etc.) and then a ram (or press or punch) is provided into the press cavity to compress the powder to form a compact having the inlet, the outlet, and the internal geometry. The compact is then removed from the press cavity, such as by another ram (or press or punch). The compact is then sintered, resulting in the unfinished spray tip including the inlet, internal geometry, and the outlet.

In another example, as indicated by block 806, forming the unfinished spray tip can include pressing and sintering to generate a spray tip blank including an inlet (e.g., 1102, etc.) and internal geometry (e.g., 1104), as well as other items. For example, a press cavity (e.g., a die, etc.), having geometry to generate the inlet and the internal geometry can be provided. Carbide powder (e.g., tungsten carbide powder) can be provided and placed into the press cavity (e.g., die, etc.) and then a ram (or press or punch) is provided into the press cavity to compress the powder to form a compact having the inlet and the internal geometry. The compact is then removed from the press cavity, such as by another ram (or press or punch). The compact is then sintered, resulting in the spray tip blank including the inlet and the outlet. The spray tip blank is then further processed to generate an outlet (e.g., 1106, etc.) to form an unfinished spray tip having an inlet, internal geometry, and an outlet. The processing of the spray tip blank to form the outlet can include grinding the spray tip blank to form the outlet, laser-ablating the spray tip blank to form the outlet, or another processing method.

As indicated by block 808, forming the unfinished spray tip can be done in various other ways.

Method 800 proceeds to block 810. At block 810, a wear-mimicking surface (or geometrical feature), such as wear-mimicking surface (or geometrical feature) 1115, is formed by removing material from the provided unfinished spray tip.

In one example, the wear-mimicking surface (or geometrical feature) is formed by laser ablation, as indicated by block 812. This can include providing the unfinished spray tip to a laser ablation system, such as the laser ablation system described in FIG. 14, and controlling the laser ablation system to laser ablate the unfinished spray tip and remove material from the unfinished spray tip to generate the wear-mimicking surface (or geometrical feature). Design data, describing the dimensions and geometry of the wear-mimicking surface (or geometrical feature) can be provided to the laser ablation system for use in controlling the laser ablation system to generate the wear-mimicking surface (or geometrical feature).

In one example, the wear-mimicking surface (or geometrical feature) is formed by hydroerosive machining (or grinding), as indicated by block 814. This can include pumping abrasive fluid under pressure against and through the internal geometry of the unfinished spray tip and the outlet. The abrasive fluid is a slurry mixture that comprises a carrier (e.g., oil or aqueous medium) and abrasive particles finely distributed within the carrier. Thus, the abrasive fluid is a suspension. The abrasive fluid is different than the fluids sprayed through the spray tip by an end user.

In one example, the wear-mimicking surface (or geometrical feature) is formed by sandblasting, as indicated by block 816. This can include forcibly propelling (e.g., with pressurized (e.g., compressed) air) abrasive solid particles against and through the internal geometry and outlet of the unfinished spray tip. The abrasive solid particles are different than the fluids sprayed through the spray tip by an end user.

The wear-mimicking surface (or geometrical feature) can be formed in various other ways, as indicated by block 818.

The processing at block 610 results in a finished spray tip having a pre-use (prior to use by an end-user), manufactured (formed during the manufacturing process) wear-mimicking surface (or geometrical feature), such as wear-mimicking surface (or geometrical feature) 1115, as well as other items (e.g., inlet, outlet, internal geometry, etc.), as indicated by block 820. Further, the finished spray tip has a corresponding projected wear curve (or projected wear rate) that is different than the projected wear curve (or projected wear rate) of the unfinished spray tip, as indicated by block 820. The corresponding projected wear curve (or projected wear rate) of the finished spray tip at block 820 is more linear than the projected wear curve (or projected wear rate) of the unfinished spray tip formed at block 802.

Although the present invention has been described with reference to preferred examples, workers skilled in the art will recognize that changes may be made in form and detail without departing from the spirit and scope of the invention.

Additionally, while a particular order of steps has been described for the sake of illustration, it is to be understood that some or all of these steps can be performed in any number of orders.

It should also be noted that the different examples described herein can be combined in different ways. That is, parts of one or more examples can be combined with parts of one or more other examples. All of this is contemplated herein.

What is claimed is:

1. A method of manufacturing a spray tip having a wear-mimicking geometrical feature, the method comprising:

pressing carbide powder in a die to form an unfinished spray tip;

providing an outlet in the unfinished spray tip; and removing material from an interior surface of the unfinished spray tip in an area surrounding an inner perimeter of the outlet to form the wear-mimicking geometrical feature extending along the interior surface of the unfinished spray tip and radially away from the inner perimeter of the outlet.

2. The method of claim 1, wherein pressing carbide powder in the die to form the unfinished spray tip comprises pressing carbide powder in the die to form the unfinished spray tip including an inlet, internal geometry, and the outlet.

3. The method of claim 1, wherein pressing carbide powder in the die to form the unfinished spray tip comprises pressing carbide powder in the die to form the unfinished spray tip including an inlet and internal geometry.

4. The method of claim 3 and further comprising removing material from the unfinished spray tip to provide the outlet in the unfinished spray tip.

5. The method of claim 4, wherein removing material from the unfinished spray tip to provide the outlet comprises removing material from the unfinished spray tip to provide, as the outlet, a cat-eye outlet.

6. The method of claim 5, and wherein removing material from the interior surface of the unfinished spray tip in the area surrounding the inner perimeter of the cat-eye outlet comprises removing a first amount of material from the interior surface of the unfinished spray tip in a first sub-area of the area surrounding the inner perimeter of the cat-eye outlet, the first sub-area associated with a first canthus of the cat-eye outlet, removing a second amount of material from the interior surface of the unfinished spray tip in a second sub-area of the area surrounding the inner perimeter of the cat-eye outlet, the second sub-area associated with a second canthus of the cat-eye outlet, and removing a third amount of material from the interior surface of the unfinished spray tip in a third sub-area of the area surrounding the inner perimeter of the cat-eye outlet, the third sub-area between the first sub-area and the second sub-area, to form the wear-mimicking geometrical feature extending along the interior surface of the unfinished spray tip and radially away from the inner perimeter of the cat-eye outlet and having a variable width such that the wear-mimicking geometrical feature is narrower in the first sub-area and second sub-area and wider in the third sub-area.

7. The method of claim 4, wherein removing material from the unfinished spray tip to provide the outlet comprises laser ablating the unfinished spray tip to form the outlet.

8. The method of claim 1, wherein removing material from the interior surface of the unfinished spray tip in the area surrounding the inner perimeter of the outlet to form the wear-mimicking geometrical feature comprises laser ablating the interior surface of the unfinished spray tip in the area surrounding the inner perimeter of the outlet to form the wear-mimicking geometrical feature extending along the interior surface of the unfinished spray tip and radially away from the inner perimeter of the outlet.

9. The method of claim 1, wherein removing material from the interior surface of the unfinished spray tip in the area surrounding the inner perimeter of the outlet to form the wear-mimicking geometrical feature comprises hydroerosive machining the interior surface of the unfinished spray tip in the area surrounding the inner perimeter of the outlet to form the wear-mimicking geometrical feature extending along the interior surface of the unfinished spray tip and radially away from the inner perimeter of the outlet.

10. The method of claim 1, wherein removing material from the interior surface of the unfinished spray tip in the area surrounding the inner perimeter of the outlet to form the wear-mimicking geometrical feature comprises sandblasting the interior surface of the unfinished spray tip in the area surrounding the inner perimeter of the outlet to form the wear-mimicking geometrical feature extending along the interior surface of the unfinished spray tip and radially away from the inner perimeter of the outlet.

11. The method of claim 1, wherein removing material from the interior surface of the unfinished spray tip in the area surrounding the inner perimeter of the outlet comprises removing a first amount of material from the interior surface of the unfinished spray tip in a first sub-area of the area surrounding the inner perimeter of the outlet and removing a second amount of material from the interior surface of the unfinished spray tip in a second sub-area surrounding the inner perimeter of the outlet to form the wear-mimicking geometrical feature extending along the interior surface of the unfinished spray tip and radially away from the inner perimeter of the outlet and having a variable width.

12. A method of manufacturing a spray tip, the method comprising:

forming a die having geometry to form a spray tip having an inlet, internal geometry, an outlet, and a wear-mimicking geometrical feature extending along a surface of the internal geometry and radially away from an inner perimeter of the outlet;

placing carbide powder in the die;

pressing carbide powder in the die to form a compact;

removing the compact from the die; and sintering the compact to form the spray tip having the inlet, the internal geometry, the outlet, and the wear-mimicking geometrical feature extending along the surface of the internal geometry and radially away from an inner perimeter of the outlet.

13. The method of claim 12, wherein forming the die having geometry to form the spray tip having an inlet, internal geometry, an outlet, and a wear-mimicking geometrical feature extending along a surface of the internal geometry and radially away from an inner perimeter of the outlet comprises forming the die having geometry to form the spray tip having the inlet, internal geometry, the outlet, and the wear-mimicking geometrical feature extending along a surface of the internal geometry and radially away from an inner perimeter of the outlet towards the internal geometry and having a variable width.

14. The method of claim 12, wherein forming the die having geometry to form the spray tip having the inlet, internal geometry, the outlet, and the wear-mimicking geometrical feature extending along a surface of the internal geometry and radially away from an inner perimeter of the outlet comprises forming the die having geometry to form the spray tip having the inlet, internal geometry comprising a dome section, the outlet, and the wear-mimicking geometrical feature extending along the surface of the dome section and radially away from an inner perimeter of the outlet.

15. A method of manufacturing a spray tip, the method comprising:

generating an unfinished spray tip having a first projected wear curve, the first projected wear curve comprising a first portion, corresponding to an initial use period, and a second portion, corresponding to a subsequent use period, the first portion less linear than the second portion; and finishing the unfinished spray tip to generate the spray tip by providing a wear-mimicking geometrical feature extending away from inner perimeter of an outlet of the spray tip and towards an interior of the spray tip, the spray tip having a second projected wear curve, the second projected wear curve more linear than the first projected wear curve.

16. The method of claim 15, wherein generating the unfinished spray tip comprises:

pressing carbide powder in a die to form the unfinished spray tip including an inlet and internal geometry.

17. The method of claim 15, wherein providing a wear-mimicking geometrical feature comprises removing material from an interior surface of the unfinished spray tip in an area surrounding the inner perimeter of the outlet.

18. The method of claim 17, wherein removing material comprises laser ablating the interior surface.

19. The method of claim 17, wherein removing material comprises at least one of: hydroerosive machining the interior surface or sandblasting the interior surface.

* * * * *